US006176061B1

(12) United States Patent
Smith

(10) Patent No.: US 6,176,061 B1
(45) Date of Patent: Jan. 23, 2001

(54) COMBINATION REINFORCEMENT BAR CONNECTOR AND GAUGE

(76) Inventor: Earl D. Smith, 1418 Duck Hunter Ct., Virginia Beach, VA (US) 23451

( * ) Notice: Under 35 U.S.C. 154(b), the term of this patent shall be extended for 0 days.

(21) Appl. No.: 09/218,471

(22) Filed: Dec. 22, 1998

(51) Int. Cl.[7] ..... E04C 5/20
(52) U.S. Cl. ..... 52/719; 52/677; 52/684; 52/686
(58) Field of Search ..... 52/677–689, 719; 403/389–393, 395–399

(56) References Cited

U.S. PATENT DOCUMENTS

| | | | | |
|---|---|---|---|---|
| 2,128,062 | * | 8/1938 | Ward | 52/677 |
| 2,714,817 | * | 8/1955 | Griffiths | 52/688 |
| 3,145,505 | * | 8/1964 | Cornelius | 52/686 X |
| 3,783,574 | * | 1/1974 | Cenerelli | 52/687 |
| 4,107,895 | * | 8/1978 | LeGrady | 52/687 |
| 4,190,999 | * | 3/1980 | Hampton | 52/687 |
| 4,617,775 | * | 10/1986 | Padrun | 52/684 |
| 5,664,389 | * | 9/1997 | Williams | 52/677 |

FOREIGN PATENT DOCUMENTS

| | | | | |
|---|---|---|---|---|
| 462777 | * | 3/1937 | (GB) | 52/677 |

* cited by examiner

*Primary Examiner*—Richard Chilcot
(74) *Attorney, Agent, or Firm*—MacMillan, Sobanski & Todd, LLC

(57) ABSTRACT

A device for expediently and efficiently adjoining overlapping segments of reinforcement bar with substantially accurate and precise measures of overlap is disclosed. The device comprises a first coupling element for coupling to a first reinforcement bar and a second coupling element for coupling to a second reinforcement bar. The device is structured and configured to gauge the amount of overlap between the first and second reinforcement bars upon coupling the first and second coupling elements to their respective reinforcement bars. A guide element may be provided to guide the second reinforcement bar into contact with the second coupling element to aid in coupling the second reinforcement bar to the second coupling element over a substantial distance. A coupling device according tot he invention may comprise two coupling components each having a first opening at a first end and a second second opening at a second end. The first component has a first abutment surface to limit the travel of a first reinforcement bar through the first component and the second component has a second abutment surface to limit the travel of a second reinforcement bar through the second component. A centering device structured and dimensioned to center each of the coupling components in a hollow block cell may also be provided.

20 Claims, 11 Drawing Sheets

COMBINATION REINFORCEMENT BAR CONNECTOR AND GAUGE

BACKGROUND OF THE INVENTION

1. Field of the Invention

The present invention relates generally to building construction and more particularly, to device for adjoining overlapping segments of interconnecting reinforcement bars.

2. Description of the Prior Art

Conventional commercial buildings are predominantly masonry construction. Foundations of commercial buildings are typically reinforced with reinforcement bar, commonly referred to as rebar, and walls of such buildings are generally constructed of block having cells filled with grouting and reinforced with reinforcement bar.

Construction of commercial buildings generally begins with the formation of footings which support walls. The footings vertically support a series of spaced apart reinforcement bar in a upright position. In accordance with known methods of construction, each reinforcement bar typically extends five feet or more above the footings, as is shown in prior art FIG. 1. The block walls are constructed with the reinforcement bar contained within. In accordance with known methods of construction, blocks have to be raised above the reinforcement bar and lowered to footing with the reinforcement bar extending through a hollow block cell. A series of blocks are laid upon one another following the same method of raising the blocks above the reinforcement bar and lowering the blocks to a subsequent course of blocks with the reinforcement bar extending through various block cells. The blocks are joined to the footings and other blocks with grouting. Once a numbered of layers of block have been laid, and while a desired length of each spaced apart reinforcement bar remains exposed beyond the block wall being formed, another length of reinforcement bar is tied to each the exposed portion of each spaced apart reinforcement bar. This method is continued until a wall of desired height is achieved. Once a wall of desired height is achieved, the block cells are filled with grouting, forming a cement masonry unit (CMU).

Depending on factors, such as the structural dimensions of the commercial building and building codes, a certain amount of reinforcement bar overlap is required. Overlap may be in the order of sixteen inches or more. In accordance with the present methods, this length of overlap is measured manually and the two segments of reinforcement bar are manually tied together with tie wire. This method is inefficient with regard to the man hours required for tying the overlapping segments together, wasteful due to excessive overlap, and lends itself to error should insufficient overlap occur.

In forming a typical foundation, layers of sand, stone and plastic are provided, and a grid of reinforcement bar is formed upon these layers. This grid is formed by overlapping segments of reinforcement bar tied together in a manner similar to that set forth above. A first layer of reinforcement bar is arranged spaced apart relative to one another. A second layer of reinforcement bar is arrange spaced apart relative to another and perpendicular to the first layer to form a grid of reinforcement bar. The two layers of reinforcement bar are tied to one another, thus fixing the two layers relative to one another.

Coupling devices for adjoining reinforcement bars are known in the prior art. For example, U.S. Pat. No. 3,390, 905, issued Jul. 2, 1968, to Donald A. Stewart, discloses holding and locating devices for overlapping structural members comprising two separately formed elements partly embrace overlapping portions of the two structural members. The elements are secured together by one or more separately formed tie members. The structural members are freely slidable in the elements. U.S. Pat. No. 4,692,052, issued Sep. 8, 1987, to Alfred A. Yee, discloses a splice sleeve for connecting overlapping reinforcement bars. The sleeve includes a rigid tubular sleeve for receiving the overlapped ends of the reinforcement bars. The tubular sleeve is filled with a hardenable material to resist axial tension exerted on the reinforcement bars. U.S. Pat. No. 5,365,715, issued Nov. 22, 1994, to James W. Steinmetz et al., discloses a rod tying a including an attachment element and a mating centering element. In use, the attachment element is attached to one of the members to be tied and the centering element is used to align and juxtapose the attachment element to a stationary member. Two coils of wire are wrapped around the attachment element and the centering element. Upon separation of the attachment element and the centering element, the coils of wire are adapted to tighten around the aligned members and tie the members together.

None of the above inventions, taken either singly or in combination with other inventions, is seen to describe the instant invention as claimed.

SUMMARY OF THE INVENTION

The present invention is a device for adjoining overlapping segments of reinforcement bars with substantially accurate and precise measures of overlap. The device comprises a pair of coupling elements for coupling two segments reinforcement bar. The device is structured and configured to gauge the amount of overlap between the reinforcement bars upon coupling the coupling elements to the reinforcement bars. A guide element may be provided for guiding a second reinforcement bar into contact with a second coupling element to couple the second reinforcement bar to the second coupling element.

The device may be comprised clips adjoined to frusticonical shaped members. The clips may include elements spaced apart so as to provide an opening for receiving a first reinforcement bar. A guide may be provided for guiding the first reinforcement bar between the clip elements into the opening. The clips are dimensioned and configured to tightly retain the first reinforcement bar in the clips.

An upper frusticonical shaped member is structured and configured to easily receive, and permit to pass therethrough, the second reinforcement bar, and to guide the second reinforcement bar into a lower frusticonical shaped member. The lower frusticonical shaped member is preferably structured and configured to receive the second reinforcement bar, however, does not permit second reinforcement bar to pass through lower frusticonical shaped member but rather is provided with an abutment surface which limits the travel of the second reinforcement bar. This arrangement couples the first and second reinforcement bars and the distance separating the upper and lower frusticonical shaped members gauges the overlap of the first reinforcement bar relative to the second reinforcement bar.

The upper and lower frusticonical shaped members may be bridged together so as to form a unitary structure. Various overlapping requirements may be met by varying the distance between the upper and lower frusticonical shaped members.

One embodiment of the invention may be comprised of a pair of adjoining tubular members, each structured and configured to receive a respective reinforcement bar. A first tubular member may have an opening at a lower end thereof for receiving a first reinforcement bar and an abutment surface at an upper end thereof for limiting the travel of the first reinforcement bar therethrough. Similarly, a second tubular member may have an opening at an upper end thereof for receiving a second reinforcement bar therethrough and an abutment surface at a lower end thereof for limiting the travel of the second reinforcement bar therethrough. The distance separating the two abutment surfaces gauges the overlap between the first and second reinforcement bars. Various overlapping requirements may be met by varying this distance.

A guide element, such as a frusticonical shaped member, may be provided at the opening of the second tubular member for guiding the second reinforcement bar into second tubular member.

In another embodiment of the invention, the device may be comprised of a single unitary structure having two pairs of opposingly directed clips lying in a common plane and bridged by a gauge. Each clip may be formed in a manner similar to that set forth above. The clips are preferably arranged to couple a first reinforcement bar parallel and juxtaposed to a second reinforcement bar. The length of the gauge bridging the two pairs of clips may be of varying dimensions to gauge the overlap of the first reinforcement bar relative to the second reinforcement bar. It should be noted that various features of any one of these embodiments may be used in combination with various other features other of these embodiments.

In yet another embodiment of the invention, the coupling device comprises two coupling components. Each component has a first end and a second end. A first opening is provided at the first end and a second opening is provided at the second end. The first component has a first abutment surface to limit the travel of a first reinforcement bar through the first component. Similarly, the second component has a second abutment surface to limit the travel of a second reinforcement bar through the second component. A centering device structured and dimensioned to center each of the coupling components in a hollow block cell may also be provided.

Various objects and advantages of this invention will become apparent to those skilled in the art from the following detailed description of the preferred embodiment, when read in light of the accompanying drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a device for adjoining overlapping segments of reinforcement bars. The device comprises a first coupling element for coupling to a first reinforcement bar and a second coupling element for coupling to a second reinforcement bar. The device is structured and configured to gauge the amount of overlap between the first and second reinforcement bars upon coupling the coupling elements to their respective reinforcement bars. A guide element may be provided to guide the second reinforcement bar into contact with the second coupling element to couple the second reinforcement bar to the second coupling element.

Figure 4:
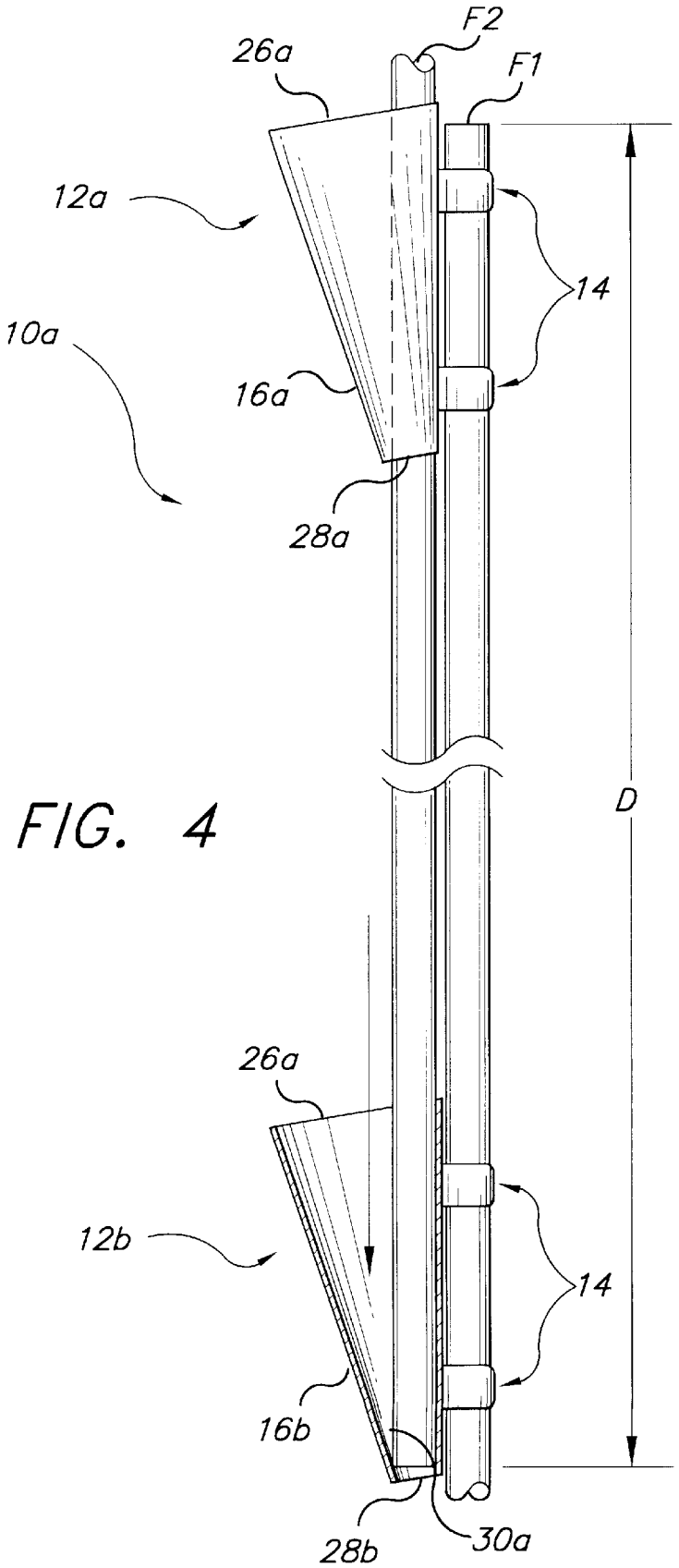
FIG. 4 is an environmental elevations view of a reinforcement bar coupling device according to the present invention shown coupling a first reinforcement bar to a second reinforcement bar.
Figure 5:
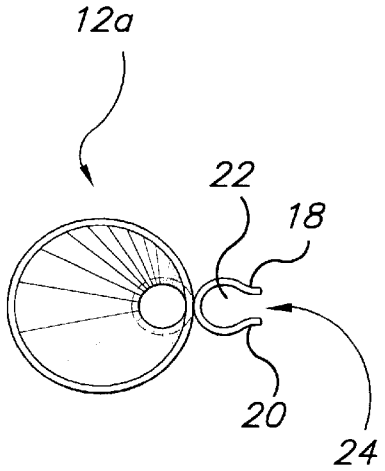
FIG. 5 is a plan view of the reinforcement bar coupling device shown in FIG. 4.

FIGS. 4 and 5 show a coupling device 10*a* comprising two components 12*a,* 12*b* each including a first coupling 14 defined by a least a first clip adjoined longitudinally and tangentially to a second coupling 16*a,* 16*b* defined by a frusticonical shaped member. The clip 14 is formed of a pair of opposingly disposed, slightly circumferential, clip elements 18, 20 each tending or biased toward the other. The clip elements 18, 20 are spaced so as to provide an opening 22 for receiving a first reinforcement bar F1 therethrough. Each of the clip elements 18, 20 may flare outwardly in opposite directions to form a guide 24 for guiding the first reinforcement bar F1 between the clip elements 18, 20. The clip 14 is dimensioned and configured to permit the first reinforcement bar F1 to snugly or tightly fit therebetween, thus retaining the first reinforcement bar F1 tightly therein. Each frusticonical shaped member 16*a,* 16*b* has a first opening 26*a* at a first end thereof which is substantially larger than the second reinforcement bar F2 and a second opening 28*a,* 28*b* at a second end thereof which is significantly smaller than the first opening 26*a.* The two components 12*a,* 12*b* of this embodiment, namely, the first component 12*a* and the second component 12*b,* differ in that the second opening 28*a* at the second end of the first component 12*a* is large enough to permit the second reinforcement bar F2 to pass therethrough but the second opening 28*b* at the second end of a second component 12*b* is not large enough to permit the second reinforcement bar F2 to pass therethrough and thus provides an abutment surface 30*a* for limiting the travel of the second reinforcement bar F2 therethrough. Upon coupling the first component 12*a* to the end of the first reinforcement bar F1 and the second component 12*b* to the first reinforcement bar F1 a predetermined distance from the first component 12*a,* the distance provided therebetween gauges the distance of overlap D of the first reinforcement bar F1 relative to the second reinforcement bar F2. Hence, various overlapping requirements may met by varying the distance between the first and second components 12*a,* 12*b*. It should be noted that these two components 12*a,* 12*b* may be bridged together by a gauge (not shown) so as to form a single unitary structure. The frusticonical shape of the second coupling 16*a,* 16*b* of the two components 12*a,* 12*b* provides a guide which allows a user to insert the second reinforcement bar F2 into the two components 12*a,* 12*b* over a substantial distance with relative case.

Figure 1:
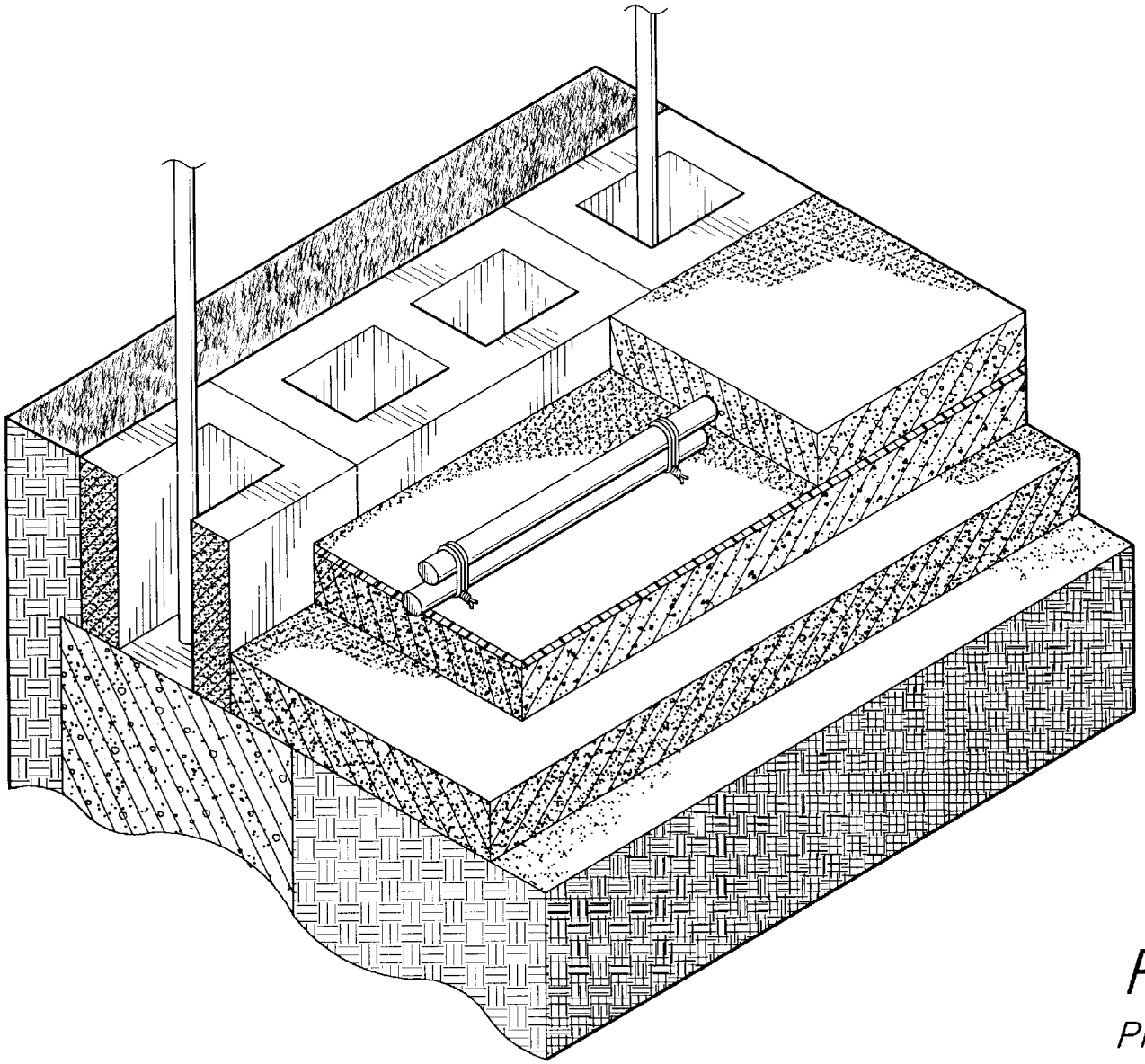
FIG. 1 PRIOR ART
FIG. 1 is a partial perspective cutaway view of a commercial construction structure according to the prior art showing a first layer of hollow cell blocks for forming a CMU wall and various layers of a cement foundation.
Figure 2:
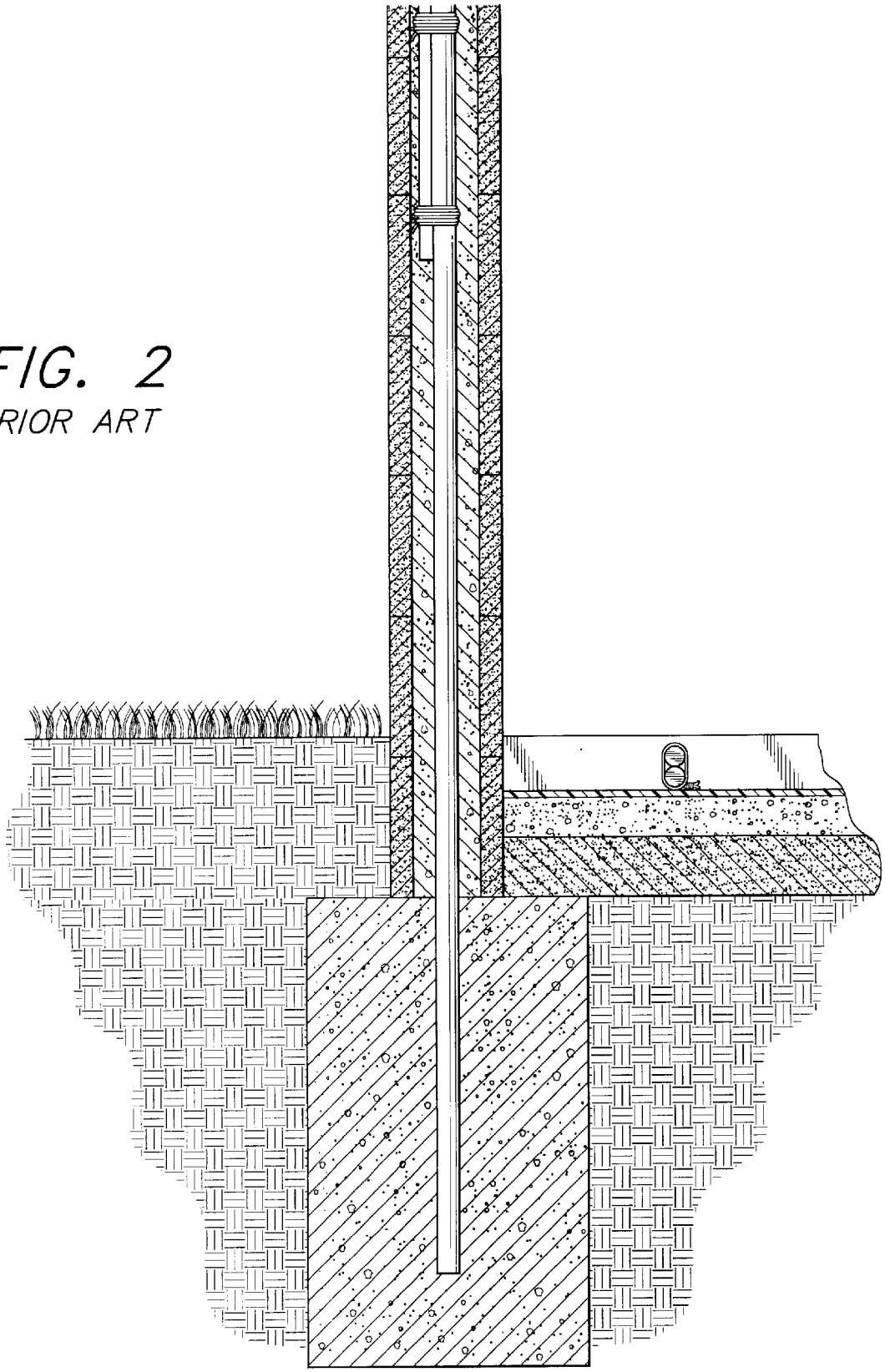
FIG. 2 PRIOR ART
FIG. 2 is a partial cross-sectional elevational view of a commercial construction structure according to the prior art showing hollow cell blocks filled with reinforcement bar and grouting forming a CMU wall, and various layers of a cement foundation.
Figure 3:
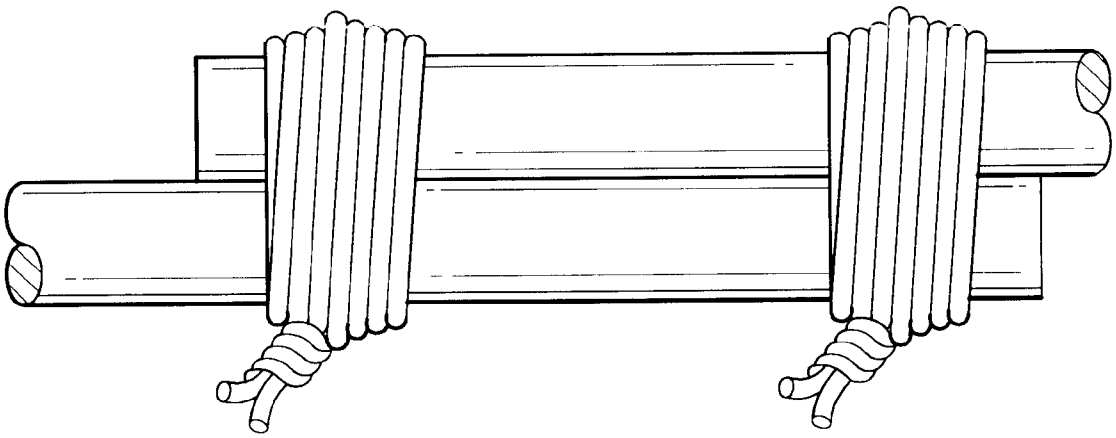
FIG. 3 PRIOR ART
FIG. 3 is an exagerated, enlarged elevational view of two segments of overlapping reinforcement bar coupled together according to the prior art with tie wire.
Figure 6:
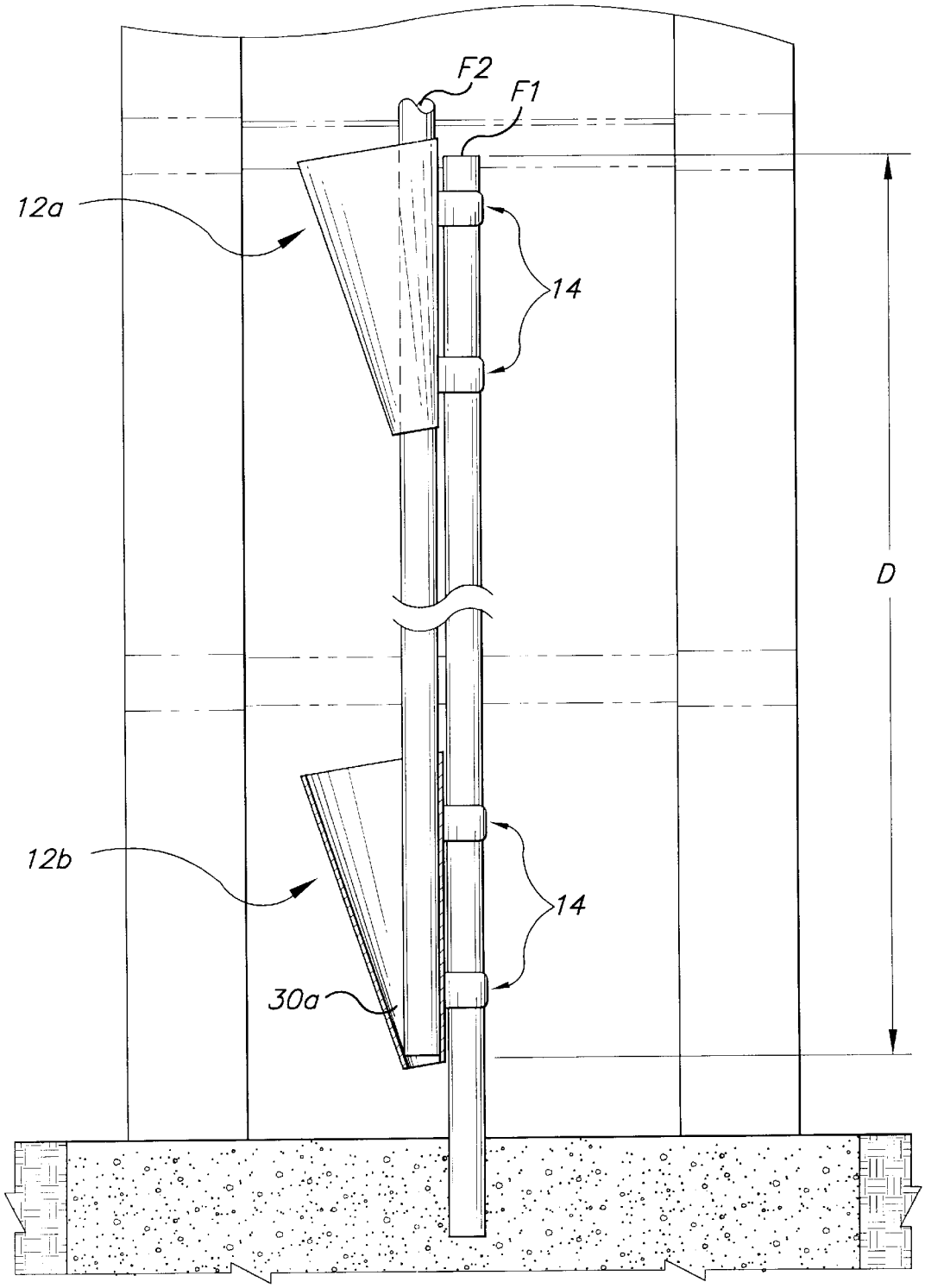
FIG. 6 is an environmental elevational view of a reinforcement bar coupling device shown in FIG. 4 further shown coupling a first reinforcement bar extending from a cement footing to a second reinforcement bar.
Figure 7:
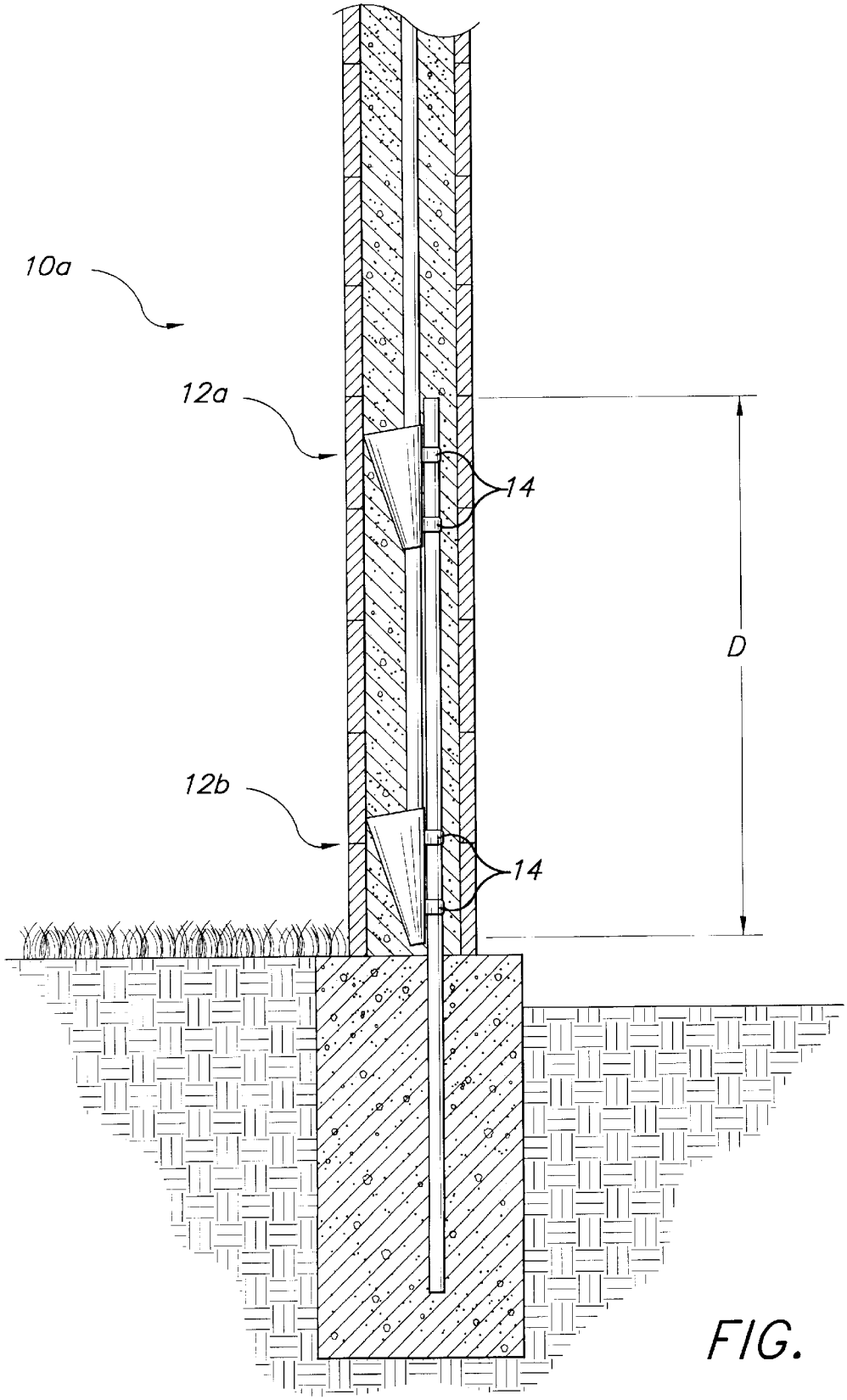
FIG. 7 is an environmental elevational view of the reinforcement bar coupling device shown in FIG. 4 further shown coupling a first reinforcement bar extending from a cement footing to a second reinforcement bar all within a hollow cell block wall filled with grouting to form a CMU wall.

FIGS. 6 and 7 show the coupling device 10*a* in use. A first reinforcement bar F1, extends from a cement footing a predetermined distance suitable for, or at least equivalent to, a desired overlapping distance D between the first reinforcement bar F1 and a second reinforcement bar F2. The two components 12*a,* 12*b* are connected to the first reinforcement bar F1 via clips 14 in a spaced apart manner to achieve a desired amount of overlap between the first reinforcement bar F1 and the second reinforcement bar F2 defined by distance D. This is a relatively short distance compared to that in conventional commercial building structures and thus is substantially less laborious to work with than that in conventional commercial building structures (see FIG. 2 illustrating PRIOR ART). After the coupling device 10*a* is clipped to the first reinforcement bar F1, hollow cell blocks are laid to form a wall. The blocks are laid until the wall reaches a height no greater than the length of the second reinforcement bar F2. This permits the second reinforcement bar F2 to be coupled to the first reinforcement bar F1 after the wall is formed. The first and second reinforcement bars F1 and F2 are coupled by inserting the second reinforcement bar F2 down through aligning hollow block cells and further through the first coupling 12*a* and into the second coupling 12*b* until the abutment surface 30*a* is reached. The foregoing process is followed if a subsequent reinforcement bar (not shown) is to be attached to the second reinforcement bar F2, and so on. This process of coupling a subsequent reinforcement bar to a former or existing reinforcement bar may be continued until a wall of overall desired height is achieved. Once a wall of overall desired height is achieved, the hollow cells are filled with grouting. The structure and configuration of this coupling device 10*a* permits grouting to form about the adjoining reinforcement bars F1, F2 and within the couplings 12*a,* 12*b,* thus forming a tight bond about and between the adjoining reinforcement bars F1, F2. It should be noted that, if through inadvertence, a coupling device 10*a* is not coupled to the first reinforcement bar F1 prior to forming a wall, a coupling device 10*a* may be clipped to the second reinforcement bar F2 via the clip elements 18, 20 and the second reinforcement bar F2 may be used to guide the coupling device 10*a* via the frusticonical shaped members 16*a,* 16*b* into contact with the first reinforcement bar F1 to couple the second reinforcement bar F2 to the first reinforcement bar F1.

Any suitable coupling element may be substituted for the clips 14 set forth above. For example, FIG. 4 of U.S. Pat. No. 3,390,905, issued Jul. 2, 1968, to Donald A. Stewart (incorporated by reference herein), discloses an arrangement of loops for receiving reinforcement bar and strips in certain of the loops to provide abutment surfaces to restrict the travel of the reinforcement bars through the loops. Although the loops are separated by a tether, it is contemplated that the loops may be separated by a substantially rigid bridge elements to suffice as a gauge. Moreover, it is contemplated that two coaligning loops may be replaced by frusticonical shaped members 16*a,* 16*b*. It should also be understood that the abutment strip set forth above may be replaced by a solid enclosure surface. Likewise, the second end of the second frusticonical shaped member 16*b* may be obstructed with a strip as shown by Stewart, or may be fully enclosed to insure that the second reinforcement bar does not pass therethrough. Let it be known that any one of embodiments set forth above renders the overlapping portions of the reinforcement bars F1, F2 substantially exposed so as to come into contact with grout filling contained within the hollow cells of the block wall.

Figure 8:
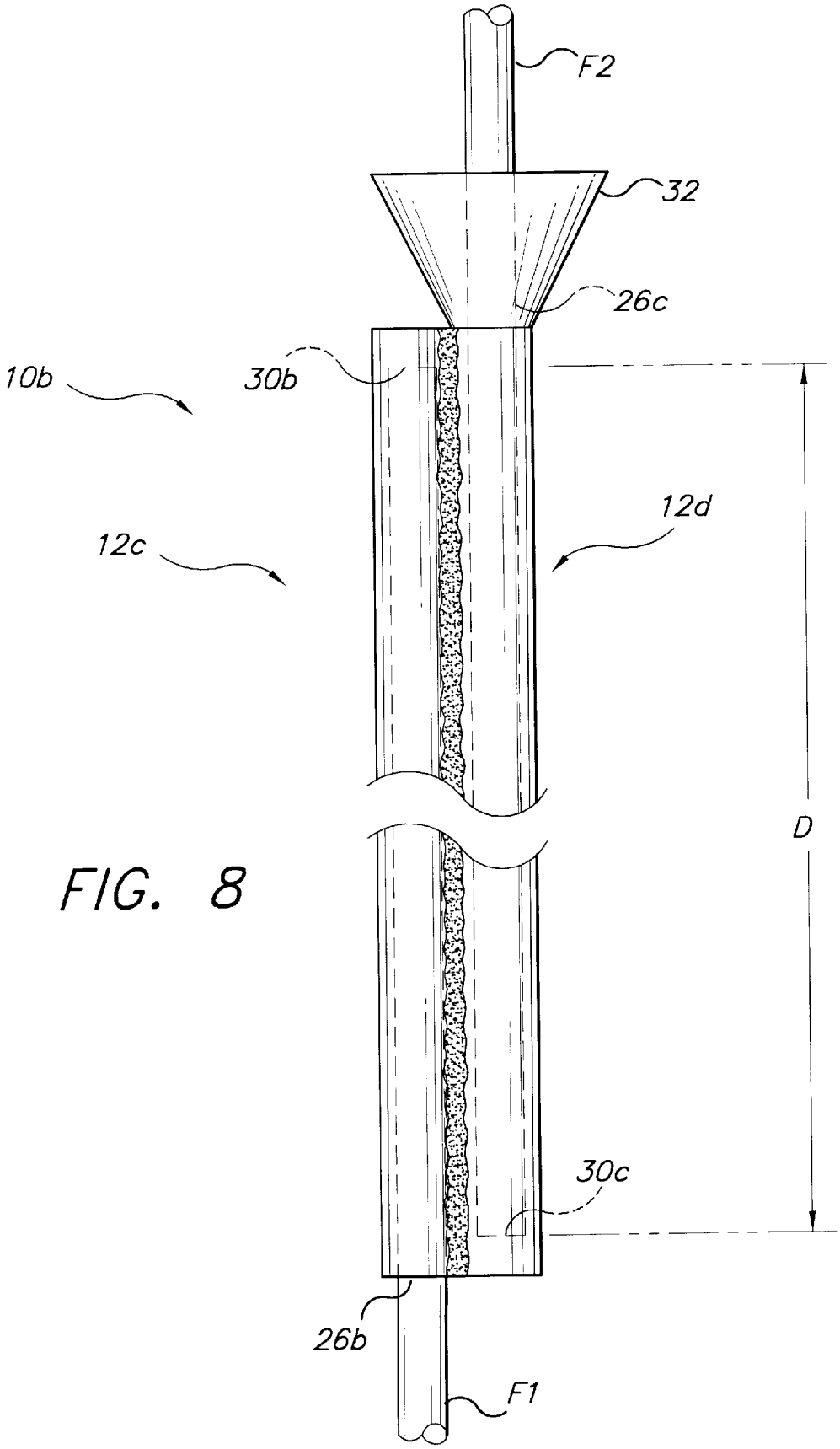
FIG. 8 is an environmental elevational view of an alternative coupling device according to the present invention.

FIG. 8 shows a coupling device 10*b* comprising a first coupling 12*c* defined by a first tubular member adjoined longitudinally and tangentially to a second coupling 12*d* defined by a second tubular member. The first tubular member 12*c* and second tubular member 12*d* are each dimensioned and configured to respectively receive the first reinforcement bar F1 and second reinforcement bar F2 therein. The first tubular member 12*c* has an opening 26*b* at a first end thereof for receiving the first reinforcement bar F1 therethrough and an abutment surface 30*b* at a second end thereof for limiting the travel of the first reinforcement bar F1 through the first tubular member 12*c* and thus precluding the first reinforcement bar F1 from passing entirely through the first tubular member 12*c*. Likewise, the second tubular member 12*d* has an opening 26*c* at a first end thereof for receiving the second reinforcement bar F2 therethrough and an abutment surface 30*c* at a second end of the second tubular member 12*d* for limiting the travel of the second reinforcement bar F2 through the second tubular member 12*d* and thus precluding the second reinforcement bar F2 from passing entirely through the second tubular member 12*d*. It should be noted that the opening 26*b* at the first end of the first tubular member 12*c* is disposed proximate the abutment surface 30*c* at the second end of the second tubular member 12*d*. Similarly, the opening 26*c* at the first end of the second tubular member 12*d* is disposed proximate the abutment surface 30*b* at the second end of the first tubular member 12*c*. In accordance with this structural configuration, the first reinforcement bar F1 enters the first tubular member 12*c* along a substantially parallel line but from an opposite direction from which the second reinforcement bar F2 enters the second tubular member 12*d*. It should also be noted that the abutment surface 30*b* at the second end of the first tubular member 12*c* is space apart from the abutment surface 30*c* at the second end of the second tubular member 12*d* a distance D equivalent to the length of overlap of the adjoining first and second reinforcement bars F1 and F2, gauging the overlap of the first and second reinforcement bar F1 and F2. Hence, various overlapping requirements may met by varying the lengths the of the first tubular member 12*c* and second tubular member 12*d*. A guide element 32, such as a frusticonical shaped member, may be provided at the opening 26*c* at the first end of the second tubular member 12*d* to guide the second reinforcement bar F2 into the opening 26*c* and further through the second tubular member 12*d* until the second reinforcement bar F2 abuts the abutment surface 30*c* at the second end of the second tubular member 12*d*. This allows a user to insert the second reinforcement bar F2 into the second tubular member 12*d* over a substantial distance and with relative ease. Hence, the user may expediently and efficiently insert the second reinforcement bar F2 into the second tubular member 12*d* after a wall has been formed to a predetermined height.

The coupling device 10*b* is used in a manner similar to that of the former coupling device 10*a* set forth above. A first reinforcement bar F1 is provided which extends from a cement footing a predetermined distance suitable for a desired amount of overlap between the first reinforcement bar F1 and a second reinforcement bar F2, defined by distance D. The is coupling device 10*b* is coupled to the first reinforcement bar F1 via first tubular member 12*c*. After the coupling device 10*b* is coupled to the first reinforcement bar F1, hollow cell blocks are laid to form a wall, similar to the wall shown in FIG. 7. The blocks are laid until the wall reaches a height no greater than the length of the second reinforcement bar F2. This permits the second reinforcement bar F2 to be coupled to the first reinforcement bar F1 after the wall is formed. The first and second reinforcement bars F1 and F2 are coupled together by inserting the second reinforcement bar F2 down through aligning hollow block cells and further through the guide element 32 and into the second tubular member 12*d* until the abutment surface 30*c* is reached. This process is followed if a subsequent reinforcement bar is to be attached to the second reinforcement bar F2 and may be continued until a wall of desired height is achieved. Once a wall of desired height is achieved, the hollow cells are filled with grouting. The coupling device 10*b* may be structure and configuration to collapse from the force of the grouting in the walls. This force, at times, may exceed 3000 pounds. A relatively thin steel structure or a plastic structure, for example, may collapse under the force of the grouting within the wall. Upon collapsing, a tighter bond between the coupled reinforcement bars F1, F2 is formed.

Figure 9:
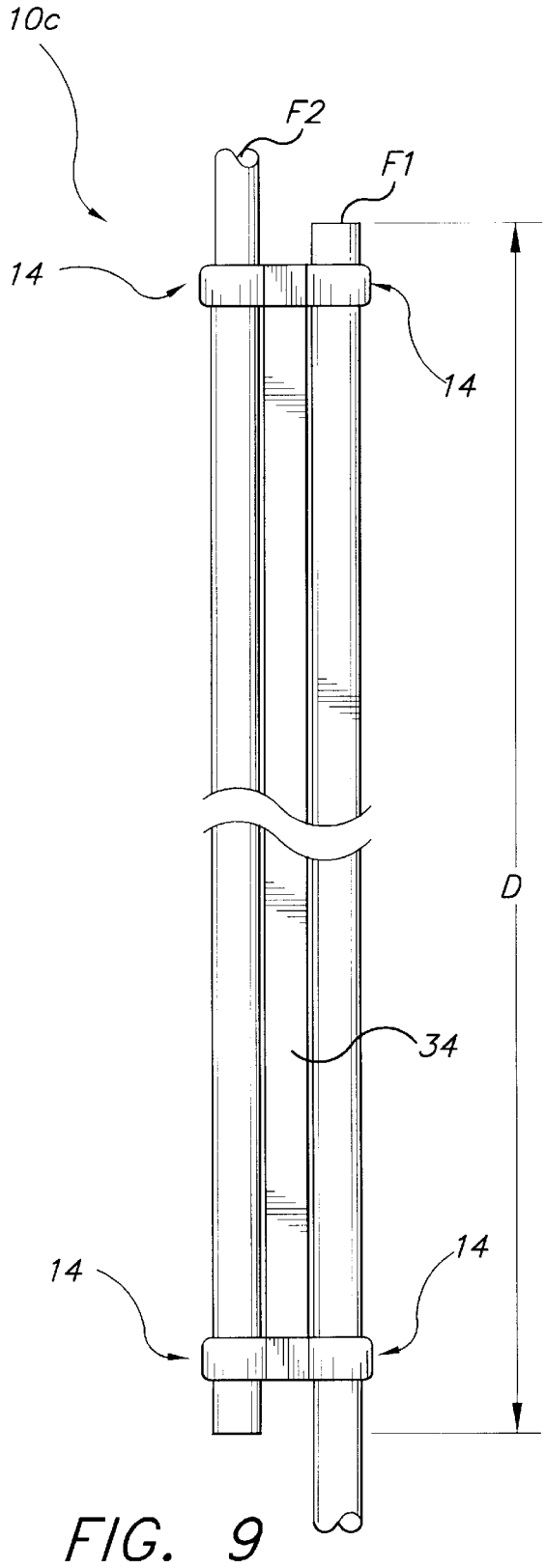
FIG. 9 is an environmental elevational view of another alternative coupling device according to the present invention.
Figure 10:
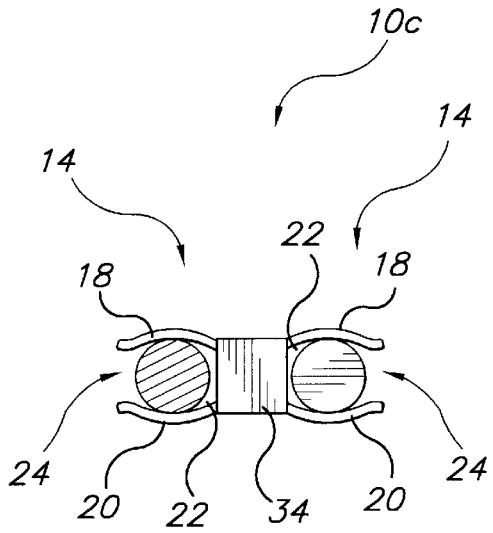
FIG. 10 is an environmental plan view of the coupling device shown in FIG. 9.

A third embodiment of the coupling device 10*c* is shown in FIGS. 9 and 10. This coupling device 10*c* may be comprised of a single unitary structure having two pairs of opposingly directed clips 14 lying in a common plane and bridged by a gauge 34 defined by a longitudinal member. Each clip 14 may be formed in a manner similar to the clips 14 of the coupling device 10*a* according to the first embodiment set forth above. By placing the clips 14 in opposing directions, a first reinforcement bar F1 may be held parallel and juxtaposed to a second reinforcement bar F2 and may be coupled to the second reinforcement bar F2 with relative ease. The length of the gauge 34 bridging the two pairs of clips 14 may be of varying dimensions to gauge the overlap of the first reinforcement bar F1 relative to the second reinforcement bar F2, defined by distance D. This latter coupling device 10*c* is structured and configured for use in the formation of walls in a manner similar to that of the two former coupling devices 10*a* and 10*b* set forth above. Although any of the coupling devices 10*a*, 10*b*, 10*c* are also suitable for use in the formation of a foundation, the latter coupling device 10*c* is especially suitable for such a purpose.

Figure 11:
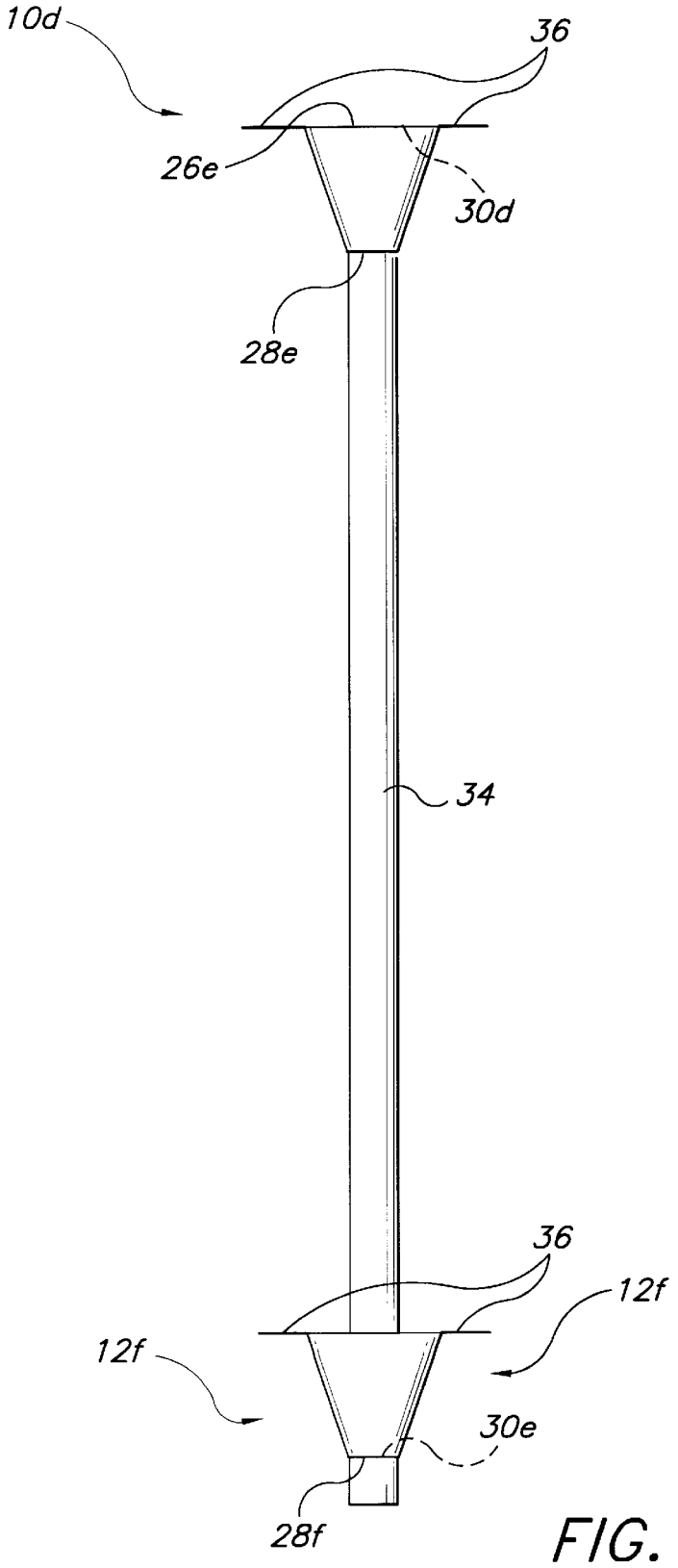
FIG. 11 is a front view of another alternative coupling device according to the present invention.
Figure 12:
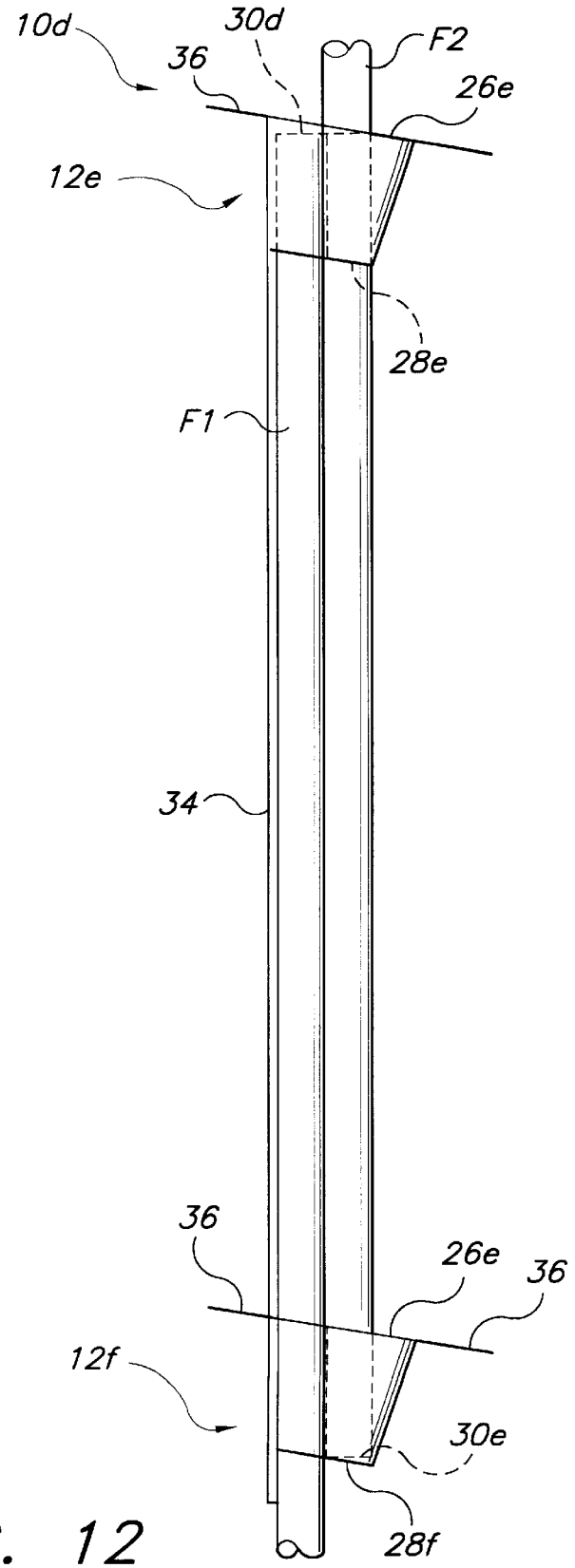
FIG. 12 is an elevational view of the coupling device shown in FIG. 11.
Figure 13:
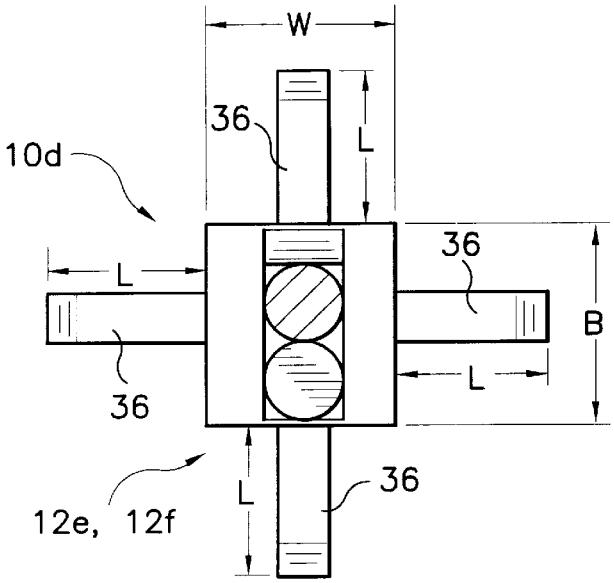
FIG. 13 is an enlarged plan view of the coupling device shown in FIGS. 11 and 12.

FIGS. 11 through 13 show a coupling device 10*d* comprising two components 12*e*, 12*f* each including a coupling 12*e*, 12*f* defined by a frusticonical tapered box-shaped member. Each frusticonical shaped member 12*e*, 12*f* has a first opening 26*e* at a first end thereof which is substantially larger than the second reinforcement bar F2 and a second opening 28*e*, 28*f* at a second end thereof which is significantly smaller than the first opening 26*e*. The two components 12*e*, 12*f* of this embodiment, namely, the first component 12*e* and the second component 12*f*, differ in that the first component 12*e* limits the travel of the first reinforcement bar F1 therethrough and the second component 12*f* limits the travel of the second reinforcement bar F2 therethrough. This can be accomplished as follows. The first opening 26*e* at the first end of the first component 12*e* may be large enough to permit the second reinforcement bar F2 to pass therethrough and be provided with a first abutment surface 30*d* to prevent the first reinforcement bar F1 from passing therethrough. Conversely, the second opening 28*f* at the second end of a second component 12*f* may be large enough to permit the first reinforcement bar F1 to pass therethrough and be provided with a second abutment surface 30*e* for limiting the travel of the second reinforcement bar F2 therethrough. The distance provided between the first and second abutment surfaces 30*d*, 30*e* gauges the distance of overlap D of the first reinforcement bar F1 relative to the second reinforcement bar F2. Hence, various overlapping requirements may be met by varying the distance between the first and second components 12*e*, 12*f*. It should be noted that these two components 12*e*, 12*f* may be bridged together by a gauge 34 so as to form a single unitary structure. The frusticonical shape of the second coupling 12*e*, 12*f* of the two components 12*e*, 12*f* provides a guide which allows a user to insert the second reinforcement bar F2 into the two components 12*e*, 12*f* over a substantial distance with relative ease.

Figure 14:
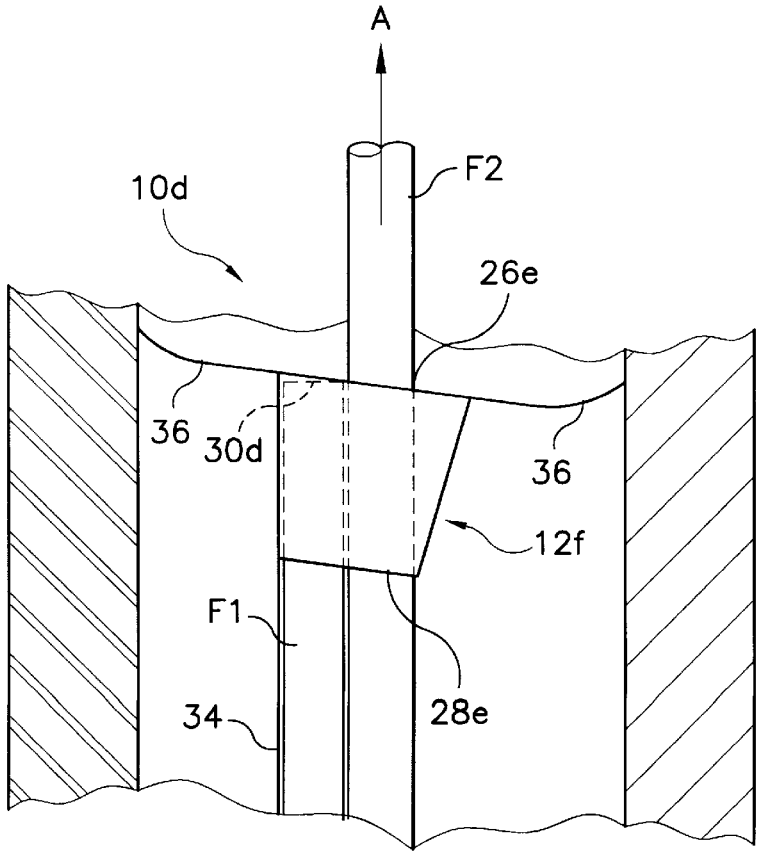
FIG. 14 is an enlarged environmental elevational view of the coupling device shown in FIGS. 11 through 13.

The coupling device 10*d* may be centered in the block cell. One manner of centering the coupling device 10*d* is as follows. The coupling device 10*d* may be provided with a centering device or configuration. For example, one or both of the components 12*e*, 12*f* may be provided with tabs 36 which are preferably spaced 90 degrees apart in a common plane, and preferably, in a substantially horizontal plane. The tabs 36 are each preferably of equal length. The sum of the length L of each tab 36 and the width W and breadth B of the components 12*e*, 12*f* is preferably slightly greater than the width and breadth of the block cell. The tabs 36 are also preferably slightly resilient in nature so as to flex slightly, as shown, for example, in FIG. 14, when inserted into the cell. This slight flexibility permits the tabs 36 to bite into the block cell perimeter wall if an attempt is made to displace the coupling device 10*d* in the direction of the arrow A, such as upon displacing the second reinforcement bar F2.

The present invention overcomes problems and disadvantages associated with the prior art, namely, it provides an expedient manner in which to couple overlapping segments of reinforcement bar, eliminating the need for laboriously tying together adjoining segments of reinforcement bar and thus significantly reducing labor costs. Labor costs are further reduced because the present invention permits reinforcement bars to be joined with hollow cell blocks after a series of blocks have been laid, thus eliminating the need to laboriously raise the blocks to relatively great heights above the reinforcement bars to lay the block, as is the case with conventional commercial construction. The present invention further provides a reduction in labor costs in that it eliminates the need to laboriously measure proper amounts of overlap between to segments of reinforcement bars as required by commercial standards and codes. In addition, to reducing labor costs, this feature reduces material waste associated with excessive overlap resulting from human error, and further reduces the risk of deficiency in overlap resulting from human error or carelessness.

In accordance with the provisions of the patent statutes, the principle and mode of operation of this invention have been explained and illustrated in its preferred embodiment.

However, it must be understood that this invention may be practiced otherwise than as specifically explained and illustrated without departing from its spirit or scope.

I claim:

1. A coupling device for coupling overlapping segments of reinforcement bar, comprising:

two coupling components each having a first opening at a first end and a second opening at a second end, said first component having a first abutment surface to limit the travel of a first reinforcement bar through said first component, said second component having a second abutment surface to limit the travel of a second reinforcement bar through said second component; and a centering device structured and dimensioned to center each said coupling component in a hollow block cell.

2. The coupling device according to claim 1, wherein said centering device comprises resilient tabs provided on said coupling components, said tabs being spaced about 90 degrees apart in a common substantially horizontal plane, said tabs further being of equal length.

3. A coupling device for coupling overlapping segments of reinforcement bar, comprising:

a first coupling element structured and configured to couple to a segment of a first reinforcement bar;

a second coupling element adjoined to said first coupling element, said second coupling element being structured and configured to couple to a segment of a second reinforcement bar;

a guide clement integral with the second coupling element, said guide element for guiding the second reinforcement bar into contact with said second coupling element to couple the second reinforcement bar and said second coupling element.

4. The coupling device according to claim 3, wherein said guide element includes a frusticonical shaped member having a first end defining a first opening and a second end defining a second opening, said first opening being substantially larger than said second opening.

5. The coupling device according to claim 3, wherein said first coupling element further includes a clip, and said second coupling element includes a frusticonical shaped member, said clip being adjoined to said frusticonical shaped member.

6. The coupling device according to claim 5, wherein said clip further includes a pair of opposingly disposed, slightly circumferential clip elements, said pair of clip elements including a first clip element and a second clip element, said first clip element being biased toward said second clip element.

7. The coupling device according to claim 6, wherein said clip elements are spaced apart so as to define an opening for receiving the first reinforcement bar therein.

8. The coupling device according to claim 7, wherein a portion of said first and second clip elements are flared outwardly in opposite directions to form a guide for guiding the first reinforcement bar therebetween into said opening.

9. The coupling device according to claim 8, wherein said clip is dimensioned and configured to snugly retain the first reinforcement bar tightly therein.

10. The coupling device according to claim 5, wherein said frusticonical shaped member includes a first and second end, said first end defining a first opening and said second end defining a second opening, said first opening being significantly larger than said second opening, said second opening being larger in diameter than the second reinforcement bar.

11. The coupling device according to claim 10, further comprising:

a second clip; and a second frusticonical shaped member, said second clip being adjoined to said second frusticonical shaped member, said second frusticonical shaped member including a first and second end, said first end of said second frusticonical shaped member defining a first opening and said second end defining a second opening, said first opening of said second frusticonical shaped member being significantly larger than said second opening of said second frusticonical shaped member, said second opening of said second frusticonical shaped member being smaller in diameter that the second reinforcement bar, thus providing an abutment surface for limiting the travel of the second reinforcement bar therethrough.

12. The coupling device according to claim 11, further comprising:

a bridge adjoining said first clip and said first frusticonical shaped member to said second clip and said second frusticonical shaped member to provide unitary structure, said bridge having a length equivalent to the length of overlapping segments of the first and second reinforcement bar.

13. The coupling device according to claim 3, further comprising:

a centering device structured and configured to center said coupling device in the cell of a hollow block.

14. A coupling device for coupling overlapping segments of reinforcement bar, comprising:

a first coupling element structured and configured to couple to a segment of a first reinforcement bar, said first coupling element including a first tubular member; and a second coupling element adjoined to said first coupling element, said second coupling element being structured and configured to couple to a segment of a second reinforcement bar, said second coupling element including a second tubular member, said first tubular member being adjoined longitudinally and tangentially to said second tubular member.

15. The coupling device according to claim 14, wherein said first tubular member includes a first end and a second end, said first end defining an opening therein for receiving the first reinforcement bar therethrough, and said second end defining an abutment surface for limiting the travel of the first reinforcement bar through said first tubular member; and said second tubular member includes a first end and a second end, said first end of said second tubular member defining an opening therein for receiving the second reinforcement bar therethrough, and said second end of said second tubular member defining an abutment surface for limiting the travel of the second reinforcement bar through said second tubular member, said opening at said first end of said first tubular member being disposed proximate said abutment surface at said second end of said second tubular member, and said opening at said first end of said second tubular member being disposed proximate said abutment surface at said second end of said first tubular member.

16. The coupling device according to claim 15, wherein said abutment surface at said second end of said first tubular member is spaced apart from said abutment surface at said second end of said second tubular member a distance equivalent to the length of the overlapping segments of the first and second reinforcement bar.

17. The coupling device according to claim 15, wherein said first tubular member is dimensioned and configured to receive the first reinforcement bar therein, and said second tubular member is dimensioned and configured to receive the second reinforcement bar therein.

18. The coupling device according to claim 15, further comprising:

a guide element disposed at said first end of said second tubular member for guiding the second reinforcement bar into said opening at said first end of said second tubular member.

19. The coupling device according to claim 18, wherein said guide element includes a frusticonical shaped member.

20. The coupling device according to claim 19, wherein said first tubular member, said second tubular member, and said guide are collapsible under a predetermined force.

* * * * *